US005181547A

United States Patent [19]

Johnson

[11] Patent Number: 5,181,547

[45] Date of Patent: Jan. 26, 1993

[54] LIQUID SPILL DEVICE ARRANGEMENT FOR LIQUID TRANSFER IN A CLOSED SYSTEM

[75] Inventor: Fontain M. Johnson, Cincinnati, Ohio

[73] Assignee: Midland Enterprises Inc., Cincinnati, Ohio

[21] Appl. No.: 766,850

[22] Filed: Sep. 27, 1991

[51] Int. Cl.[5] ..... B65B 31/00

[52] U.S. Cl. ..... 141/46; 141/86; 141/95; 141/198; 137/571; 137/587

[58] Field of Search ..... 141/44, 45, 46, 51, 141/59, 86, 88, 198, 311 A, 95; 137/571, 576, 574, 587; 114/74 A, 74 R; 220/565, 553, 501, 4.12, 89.1, 203, 208, 209

[56] References Cited

U.S. PATENT DOCUMENTS

| | | | |
|---|---|---|---|
| 2,314,555 | 3/1943 | Preuss | 114/74 |
| 3,288,098 | 11/1966 | Garate | 114/74 |
| 3,844,239 | 10/1974 | McLaughlin et al. | 114/74 |
| 3,926,135 | 12/1975 | DeGregorio | 114/74 |
| 4,144,829 | 3/1979 | Conway | 114/74 |
| 4,615,362 | 10/1986 | Hartman et al. | 141/98 |
| 4,723,573 | 2/1988 | Burnett | 137/571 |
| 4,964,437 | 10/1990 | Tornay | 137/1 |

*Primary Examiner*—Henry J. Recla
*Assistant Examiner*—Steven O. Douglas
*Attorney, Agent, or Firm*—Wood, Herron & Evans

[57] ABSTRACT

A liquid spill device arrangement is disclosed for liquid transfer in a closed system from a terminal or other sender facility to a vessel, such as a tanker vessel, and vapor/gas transfer from the vessel to the sender facility. A single spill device is used to serve multiple tanks of a tanker vessel.

9 Claims, 1 Drawing Sheet

LIQUID SPILL DEVICE ARRANGEMENT FOR LIQUID TRANSFER IN A CLOSED SYSTEM

FIELD OF THE INVENTION

This invention is directed to a liquid spill device arrangement for liquid transfer in a closed system, such as between a sending shore facility and a receiving tanker vessel.

BACKGROUND OF THE INVENTION

Liquid spill devices are usually required and installed as part of a closed liquid transfer system to prevent catastrophic tank failure by rupture in the event a tank is overfilled. A closed transfer system (also called a vapor recovery system) allows liquid cargo to flow from a sender facility, such as a terminal, to a receiving facility, such as a tanker vessel, and accommodates a flow of vapors or gases that occupy the tanks of the receiving facility back to the sending facility. Thus, no cargo in the form of gas or vapor is emitted to the atmosphere. While in theory the process for such liquid transfer appears simple, in practice a number of problems are encountered.

Among the many problems that must be dealt with in a closed liquid transfer system is the provision of some means of knowing and tracking liquid levels in various tanks to accommodate custody transfer and to prevent liquid overfill. Pressure in the tanks must be regulated or controlled to prevent tanks from being overpressured or underpressured, either of which could result in catastrophic tank failure. If tank pressure regulation or control fails, means must be provided to relieve the pressure or vacuum in the tank to prevent catastrophic failure. Furthermore, if the tank is overfilled, means must be provided to allow the liquid to spill out of the tank to prevent catastrophic tank failure. There are numerous methods of dealing with each of the above problems and, for instance, for inland and coastal navigational purposes, the U.S. Coast Guard has developed and implemented regulations for such systems in tanker or barge vessels. The most recent regulations are included in 46 CFR §§ 30 et seq.

SUMMARY OF THE INVENTION

This invention is directed to a liquid spill device arrangement for use in a closed liquid transfer system from a sender facility to a receiver vessel. The invention has particular application in transfer systems between a terminal shore facility and a tanker cargo vessel on an inland or coastal waterway. The spill device arrangement of this invention prevents catastrophic tank failure by rupture in the event a tank is overfilled. Also, the invention provides a spill device arrangement that works in conjunction with a backup system on the receiver vessel for control of gas/vapor of cargo liquids in the event of failure of the primary control system of the sending facility.

In a preferred form, the liquid spill device arrangement works in conjunction with a primary control system for pressurized transfer of liquid from a sender facility, such as an inland terminal, to a receiver vessel, such as a tanker vessel, and for transfer of gas/vapor from the receiver vessel to the sender facility. The receiver vessel has multiple tanks for containment of liquid with a common boundary between the tanks. A pressure relief means for venting gas/vapor at a selected relief pressure from the receiver vessel to atmosphere is provided when the pressure of the control system is exceeded. In one preferred form, a top of each tank has an opening therein in proximity to the common boundary. More broadly stated, the tanks have an opening near their tops in proximity to the common boundary. A closed trunk connects the tanks through the openings, or common opening, and allows liquid to flow from one tank to another. The liquid spill device is mounted in the trunk in communication with the tanks and opens at a pressure allowing overfill liquid to flow from containment in said tanks to prevent exceeding their structural design pressure. The liquid spill device opens at a pressure equal to or greater than the selected gas/vapor relief pressure of the receiver vessel.

These advantages and other objectives of this invention will be further understood with reference to the following drawings and detailed description.

DETAILED DESCRIPTION

Figure 1:
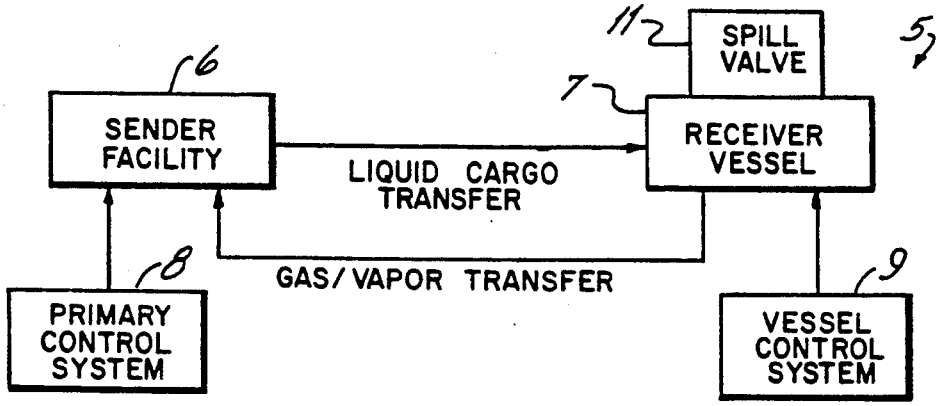
FIG. 1 is a diagrammatic representation of a closed liquid transfer and vapor recovery system between a sender facility and a receiver vessel.

With reference to FIG. 1, a closed liquid transfer system and vapor recovery 5 is shown in diagrammatic form allowing for liquid cargo to flow from a sender facility 6 to a receiver vessel 7. Typically, a shore terminal serves as a sender facility and a tanker vessel on an inland or coastal waterway serves as the receiver facility 7. The system accommodates the flow of gases or vapors (herein sometimes simply "gas/vapor") that occupied the tanks of the receiver facility back to the sender facility. Thus, no cargo in the form of gas or vapor is emitted to the atmosphere.

The closed liquid transfer system 5 of FIG. 1 usually works by regulating pressure in the receiver vessel's tanks by sensing the pressure in the pipeline at the receiver tank vessel 7 or connection. This pressure is regulated within certain specified limits by speeding up or slowing down either the liquid flow into the tanker vessel 7 or gas/vapor flow from the tanker vessel, or both. This system of transfer is known as the primary control system. If the primary control system 8 fails, the tanker vessel 7 is protected by a vessel control system 9, i.e., a pressure/vacuum relief means. In the case of underpressure or vacuum, the pressure/vacuum relief means is set to operate at a vacuum greater than the extreme vacuum operating range of the primary control system 8. In the case of overpressure, the pressure relief means activates only at a pressure greater than the upper pressure limit of the primary control system 8. Thus, cargo vapor or gas is vented to atmosphere from the receiving tanker vessel only when the primary control system 8 upper pressure limit has been exceeded. If tanker vessel level control fails and any tank overfills, the spill valve arrangement 11 of this invention allows full liquid flow to egress from the tanker vessel such that the structural design pressure of the tank is not exceeded. Furthermore, at the same time, the spill device only activates or opens at a pressure equal to or greater than the pressure in the vessel tank when maximum vapor flow is occurring through the pressure relief means. If such were not the case, the gas/vapor would be relieved from the spill device instead of the pressure relief device. In the case of tanker vessel construction, such is not acceptable because the release of vapors or gases must be at a height of about 4 to 8 feet above the tanker vessel top for disbursement, whereas a spill device 11, by necessity, must be very close to the tanker vessel top.

Figure 2:
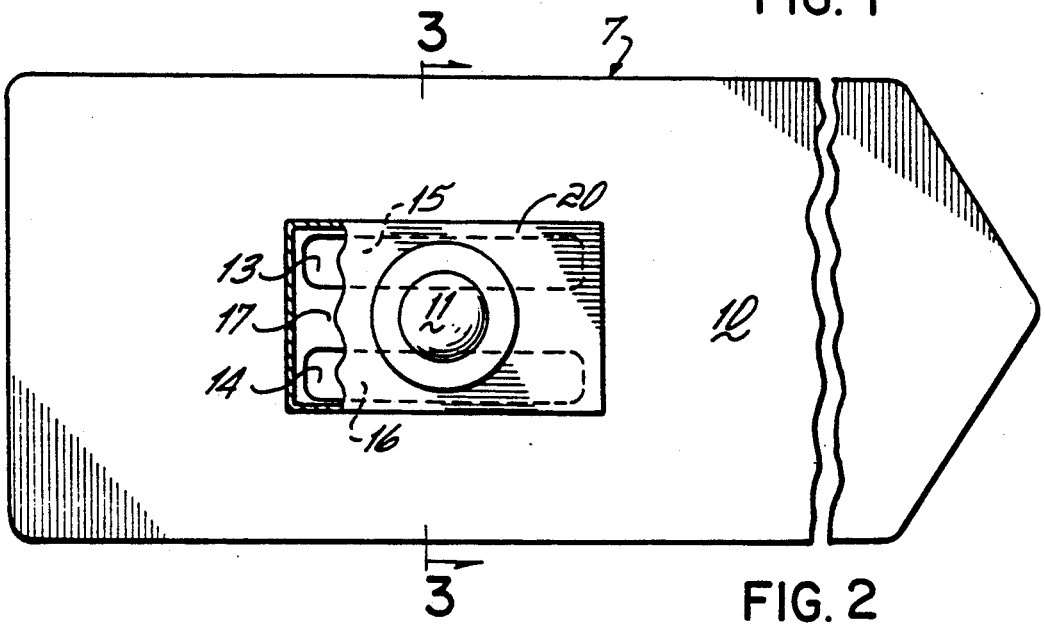
FIG. 2 is a schematic plan view of the deck of a tanker vessel having installed the spill device of this invention.
Figure 3:
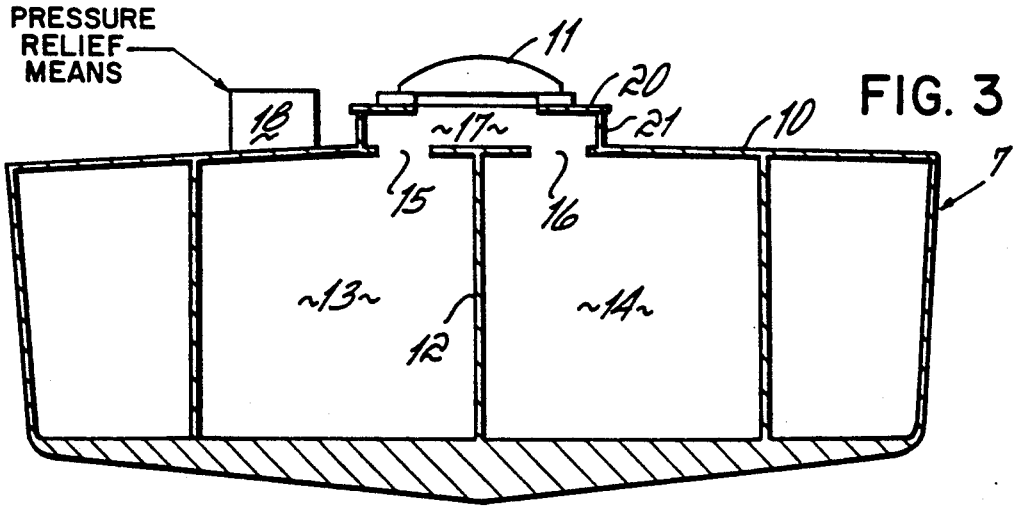
FIG. 3 is a sectional view along lines 3—3 of FIG. 2.

With reference to FIG. 2, a schematic plan view of a tanker vessel deck 10 is shown with the liquid spill device 11 of this invention. FIG. 3 is a cross-sectional view of FIG. 2 showing partially in schematic form the deck 10 and bulkhead 12 of a tanker vessel. The receiving tanker vessel has multiple tanks 13, 14 for containment of liquid with a common boundary or bulkhead 12 between the tanks 13, 14, as shown in FIG. 2. A pressure relief means for venting gas/vapor at a selected relief pressure from the tanker vessel to atmosphere is shown generally at 18, as part of the vessel control system, when the pressure of the primary control system is exceeded. As referred to generally in FIG. 1, a primary control system for pressurized transfer of liquid from a sender terminal facility 6 to the receiving tanker vessel 7 is provided and for transfer of gas/vapor from the tanker vessel 7 to the sender facility.

A top of each tank 13, 14 has an opening 15, 16 therein adjacent the common bulkhead 12. A closed trunk 17 connects the tanks through the openings 15, 16 and allows liquid to flow from one tank to another. The liquid spill device 11 is mounted to the trunk 17 in communication with both tanks 13, 14. The spill device 11 is activated or opens at a pressure allowing overfill liquid to flow from containment in the tanks 13, 14 to prevent exceeding structural design pressure, thereby resulting in catastrophic rupture. The liquid spill device 11 opens at a pressure equal to or greater than the selected gas/-vapor relief pressure means 18 of the receiving tanker vessel.

The closed trunk 17 of the spill device arrangement has a low profile horizontal top plate 20 extending over the tank openings 15, 16 and side walls 21 connecting the top plate 17 to the tops of the tanks 13, 14. The liquid spill device 11 is mounted on the top of said horizontal plate 20 for communication with both tanks 13, 14. The dimensions of the liquid spill device 11 will vary depending upon the environment for utilization. In the case of a tanker vessel, for instance, the device may be installed in a top plate 20 of about 3'-3¼"×1'-11¼" so as to cover adjacent openings 15, 16 in the deck 10 that are about 3' long and about 6" wide. The side walls 21 connecting the top plate 20 to the deck 10 of the vessel only extend about 3" above the deck 10 so as to completely enclose the openings 15, 16 in adjacent tanks 13, 14 having a common center line bulkhead 12 with the openings spaced apart by about 8". A center hole of approximately 11" in diameter is provided in the top plate for a spill device 11 that operates at a pressure equal to or greater than the gas/vapor relief pressure means 18 of the tanker vessel. The detailed pressure valve structure of spill device 11 is well known and is not shown. Similarly, gas/vapor relief pressure means 18 detail is well known and is not shown. Thus, the arrangement provides a low profile closed trunk over multiple tanks at their common boundary. This trunk is of such a horizontal area so as to allow large enough common openings from the trunk into each tank such that pressure loss due to flow through the openings is very small. Each of the multiple cargo tanks 13, 14, via these openings 15, 16, can then be given access to a single common spill device 11 mounted in the top of the low profile closed trunk 17 which encompasses all the openings of the multiple tanks as shown in FIGS. 2 and 3. Thus, the multiple tanks have a common opening therein near their tops in proximity to the common boundary with access to a single spill valve mounted on the top of at least one of the tanks in communication with the multiple tanks.

In operation, in the case of U.S. Coast Guard Regulations for Tanker Vessels, the setting of gas/vapor relief pressure means 18 on the tanker vessel is such that it relieves at a pressure in the vapor space of the tanker of not less than one (1) psig. Thus, the liquid spill device must operate at a pressure equal to or greater than the vessel tank pressure when maximum flow is occurring through the relief pressure means 18 and less then the structural design pressure of the tank. This pressure operating range is very small. Since the pressure relief means 18 first opens due to static pressure, the pressure in the vapor space of the tanker vessel will increase during maximum flow due to dynamic flow losses in the vapor piping system. Thus, the pressure in the vapor space above which the spill device 11 must activate is about 1.5 to 1.7 psig. The design pressure of the tank can be as low as 1.732 psig per ABS Rules for Steel Vessels on Rivers and Intracoastal Waterways (1980), but is usually in the 2.25 to 2.5 psig range. Even if one were to allow no tolerance between the maximum pressure in the tanker vessel vapor space when the pressure relief means 18 is operating at maximum flow rate and the pressure at which the spill device 11 opens, the allowable pressure range for static and dynamic flow losses from the tank through the spill valve is still very small. A typical relationship of pressures in a closed transfer system for tanker vessels is shown in the following Table I:

| Pressure PSIG | Typical Relationship of Pressure In a Closed Transfer System |
|---|---|
| 0 | Atmospheric Pressure |
| 0.92 | Pressure range of Primary Control System |
| 0.92 | Maximum pressure maintained at vessel/shore connection by Primary Control System |
| 0.28 | Pressure loss due to flow of vapor from most remote tank to vessel/shore connection maximum control rate |
| 1.20 | Maximum pressure in cargo tank vapor space when Primary Control System at maximum of range |
| 0.30 | Tolerance required by USCG Regs between maximum pressure in vapor space and opening of pressure relief valve |
| 1.5 | Pressure at which pressure relief valve begins to open |
| 0.20 | Pressure loss through relief valve by dynamics of vapor flow |
| 1.7 | Pressure in cargo tank vapor space when relief valve open and vapor flowing at maximum rate. Also, pressure at which spill device begins to open |
| 0.41 | Pressure loss through spill valve by dynamics of maximum liquid flow |
| 2.11 | Pressure in cargo tank vapor space when spill device fully open @ maximum liquid flow rate |
| 0.209 | Static pressure loss due to elevation of spill valve above top of cargo tank |
| 2.319 | Maximum pressure in cargo tank with spill valve fully open and flowing at maximum rate. Must be less than design pressure of cargo tank. |

Although the values shown in Table I can vary somewhat, the allowable static pressure loss due to liquid flow from a tank through the liquid spill device is, in any case, very small. It is because of this small allowable static pressure loss that the U.S. Coast Guard stated, on page 25424 of the Jun. 21, 1990 Federal Register, it is a requirement that each cargo tank have its own spill device. Contrary to the requirements of the U.S. Coast Guard, the liquid spill device arrangement of this invention overcomes any excessive dynamic and static pressure losses by using a low profile closed trunk over multiple tanks at their common boundary. According to this invention, only a single common spill device is mounted on the top of a low profile closed trunk to encompass openings of the multiple tanks as shown in FIG. 2. Thus, contrary to the expectations of designers of skill in this art and regulations, this invention affords the economic advantage of eliminating multiple liquid spill valves and still guards against catastrophic tank failure. The single spill valve device in the closed trunk provides such a horizontal area as to allow large enough common openings from the trunk into each tank such that pressure loss due to flow through the openings is very small, thereby preventing dynamic and static pressure losses to exceed those allowable values.

In view of the above detailed description and drawings and the description of the best operating mode of this invention, other variations will become apparent to a person of ordinary skill in the art and such variations or other embodiments are within the scope and spirit of this invention.

What is claimed is:

1. A liquid spill device arrangement for use in a closed liquid transfer system from a sender facility to a receiver vessel comprising a receiver vessel having multiple tanks for containment of liquid with a common boundary between said tanks, said receiving vessel for receiving liquid from the sender facility and for transfer of gas/vapor from the receiver vessel to the sender facility, a pressure relief means for venting gas/vapor at a selected relief pressure from the receiver vessel to atmosphere, said tanks having an opening therein near their tops in proximity to said common boundary, a closed trunk connecting said tanks through said opening and allowing liquid to flow from one tank to another, a liquid spill device mounted to said trunk in communication with said tanks, said spill device for opening at a pressure allowing overfill liquid to flow from containment in said tanks to prevent exceeding their structural design pressure, said liquid spill device opening at a pressure equal to or greater than said selected gas/vapor relief pressure of the receiver vessel.

2. The liquid spill device arrangement of claim 1 for use in the closed liquid transfer between a shore terminal sender facility and a receiver vessel on an inland or coastal waterway.

3. The liquid spill device arrangement of claim 1 for use in the closed liquid transfer between a water borne vessel sender facility and a receiver vessel on an inland or coastal waterway.

4. A liquid spill device arrangement for use in a closed liquid transfer system from a sender facility to a tanker vessel comprising a tanker vessel having multiple tanks for containment of liquid with a common boundary between said tanks, said tanker vessel for receiving liquid from the sender facility and for transfer of gas/vapor from the tanker vessel to the sender facility, a pressure relief means for venting gas/vapor at a selected relief pressure from the tanker vessel to atmosphere, said tanks having an opening therein near their tops in proximity to said common boundary, a closed trunk connecting said tanks through said opening and allowing liquid to flow from one tank to another, a liquid spill device mounted to said trunk in communication with said tanks, said spill device for opening at a pressure allowing overfill liquid to flow from containment in said tanks to prevent exceeding their structural design pressure, said liquid spill device opening at a pressure equal to or greater than said selected gas/vapor relief pressure of the tanker vessel.

5. The liquid spill device arrangement of claim 4 wherein said closed trunk comprises a low profile horizontal top plate extending over said openings and side walls connecting said top plate to the tops of said tanks, said liquid spill device mounted in said top plate for communication with said tanks.

6. The liquid spill device arrangement of claim 4 wherein said multiple tanks comprise at least a pair of tanks and a single liquid spill device is mounted in said trunk in communication with said pair of tanks.

7. The liquid spill device arrangement of claim 4 wherein said pressure relief means for venting gas/vapor is at a height of about 4 to 8 feet above the top of the tanks.

8. A liquid spill device arrangement for use in a closed liquid transfer system from a sender facility to a tanker vessel comprising a tanker vessel having multiple tanks for containment of liquid with a common boundary between said tanks, said tanker vessel for receiving liquid from the sender facility and for transfer of gas/vapor from the tanker vessel to the sender facility, a pressure relief means for venting gas/vapor at a selected relief pressure from the tanker vessel to atmosphere, a top of each tank having an opening therein in proximity to said common boundary, a closed trunk connecting said tanks through said openings and allowing liquid to flow from one tank to another, a single liquid spill device mounted to said trunk in communication with said tanks, said spill device for opening at a pressure allowing overfill liquid to flow from containment in said tanks to prevent exceeding their structural design pressure, said liquid spill device opening at a pressure equal to or greater than said selected gas/vapor relief pressure of the tanker vessel.

9. The liquid spill device of claim 8 wherein said multiple tanks comprise at least a pair of tanks and said closed trunk comprises a low profile horizontal top plate extending over said openings and side walls connecting said top plate to said tank tops.

* * * * *